United States Patent [19]

Schwarz

[11] Patent Number: 4,526,402

[45] Date of Patent: Jul. 2, 1985

[54] SKI GUARD

[76] Inventor: Günter Schwarz, Alte Steinacherstr. 15, CH-8804 Au ZH, Switzerland

[21] Appl. No.: 439,230

[22] Filed: Nov. 4, 1982

[30] Foreign Application Priority Data

Jan. 21, 1982 [CH] Switzerland ..... 386/82

[51] Int. Cl.[3] ..... A63C 11/00

[52] U.S. Cl. ..... 280/817

[58] Field of Search ..... 280/817, 601, 605

[56] References Cited

U.S. PATENT DOCUMENTS

| | | | |
|---|---|---|---|
| 3,951,425 | 4/1976 | Lohr | 280/817 |
| 4,219,206 | 8/1980 | Kjesbo | 280/817 |
| 4,304,421 | 12/1981 | Kuhbier | 280/817 |

FOREIGN PATENT DOCUMENTS

| | | | |
|---|---|---|---|
| 2430570 | 1/1976 | Fed. Rep. of Germany | 280/817 |
| 2716596 | 10/1978 | Fed. Rep. of Germany | 280/817 |
| 2510315 | 6/1982 | Fed. Rep. of Germany . | |
| 2645109 | 9/1983 | Fed. Rep. of Germany . | |

*Primary Examiner*—David M. Mitchell
*Assistant Examiner*—Joseph G. McCarthy
*Attorney, Agent, or Firm*—Toren, McGeady, Stanger

[57] ABSTRACT

A ski guard is formed of an elastically tiltable stirrup made of a plastics material with a holding member formed as a part of the stirrup. The holding member maintains the stirrup member in the upright position on a ski by securing its support surface in contact with the upper surface of a base member which attached the stirrup to a ski. When the stirrup tilts or pivots, the support surface on the holding member moves over a boundary surface on the base member overcoming a dead-center position. Movement beyond the dead-center position takes place because of the deflection of a part of the holding member spaced from the support member. Axle journals in spaced axial alignment pivotally mount the stirrup on the base member and permit the location of a large locking element between them for detachably fastening the base member on a fastening plate.

19 Claims, 16 Drawing Figures

SKI GUARD

SUMMARY OF THE INVENTION

The present invention is directed to an elastically tiltable ski guard having at least one bearing axle extending transversely of the ski with the axle supported in the base member attached to the ski.

In German Offenlegungsschrift No. 26 45 109, a ski guard of this general type is disclosed constructed in the form of a triangular stirrup of spring wire with the stirrup ends supported in a plate-shaped base member. The stirrup ends are bent inwardly toward one another. The stirrup is maintained in the upright working position because the two stirrup ends directed toward one another form the bearing axles for the ski guard, however, the bearing axles are spaced apart in the long direction of the ski. When the ski guard is tilted, that is the stirrup, an elastic deformation occurs in the stirrup which tends to return it into the upright working position. Since the two bearing axles are offset with respect to one another in the long direction of the ski, the stirrup assumes a diagonal position and its necessarily relatively long bearing axles require support in the base member and the space requirement for their support interferes with the arrangement of a detachable connecting member, such as a rotary closure, for engagement with a fastening plate permanently mounted on the ski surface by an an adhesive. In FIGS. 1 to 5 of German Offenlegungsschrift No. 26 22 089, a ski guard of the above type is disclosed having bearing axles offset relative to one another in the long direction of the ski. These bearing axles are bent at their ends and are held at the bent ends in the base member. Partial tilting of the ski guard against elastic torque of the bearing axles is possible, However, the torsional stress developed is so great that a complete tilting of the ski guard is not possible. Further, this ski guard greatly limits the design possibilities for its base member, due to the space requirements of the torsion axles and the bearing axles.

In another German Offenlegungsschrift No. 25 10 315, a wire stirrup is known which during skiing can be swivelled elastically about an axle extending transversely of the ski. While the stirrup does not have the disadvantages concerning the space requirement for the support of the axle in the two ski guards discussed above, the swivel range of the stirrup is limited and it does not spring back into the working position if it swivels beyond the limited angular extent.

Therefore, the primary object of the present invention is to provide a ski guard of the general type discussed above which avoids the disadvantages of the known ski guards in that it does not require any bearing axles offset in the long direction of the ski and, nevertheless, has a large swivel range with a high stability in its working position.

In accordance with the present invention, an elongated holding member is attached at least at one location to the swivelable stirrup. At least for a portion of its length, the holding member is separated from the stirrup. The holding member is pivotally displaceable with the stirrup and it is also elastically deformable relative to it. At a position spaced from its attachment to the stirrup, the holding member has a support surface in contact with the base member securing the stirrup onto the ski. The support surface is located on the holding member at a position most remote from the attachment location of the holding member to the stirrup.

The ski guard embodying the present invention is particularly suited to be produced from a plastics material because its swivelable part, including its bearing axles, can be formed relatively flat in one plane. To-date it had been considered necessary to form ski guards of spring steel wire where such guards due to their shape had an elastic tiltable characteristic based on the material used. According to an essential feature of the present invention, the construction of a springy elastic plastics material, such as a polycarbonate, is advantageous in the production of the ski guard because it avoids wire bending techniques and further it also provides more advantageous design possibilities based on suitability of the material as well as aesthetics. Moreover, the steel edges of the ski which contact the ski guard are protected. Furthermore, in accordance with the present invention, the shaping of the ski guard makes it possible to use most types of plastics material without the development of excessively large material stresses.

The various features of novelty which characterize the invention are pointed out with particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

DETAIL DESCRIPTION OF THE INVENTION

Figure 1:
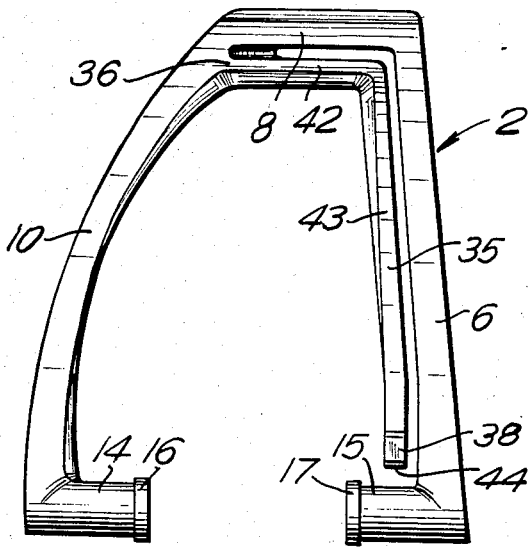
FIG. 1 is a front view of the tiltable part of a ski guard viewed in the long direction of a left ski.

In FIG. 1, a swivelling part 2, the most important part, of a ski guard is illustrated. This part 2 could be used without a base member 4, note FIG. 3, if the swivellable part can be mounted directly in appropriate recesses or support bores provided in the sides of the ski. The swivellable part 2 is formed of an elastic plastics material.

Figure 2:
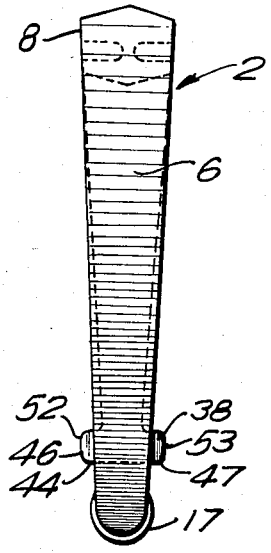
FIG. 2 is a side view of the ski guard shown in FIG. 1.
Figure 4:
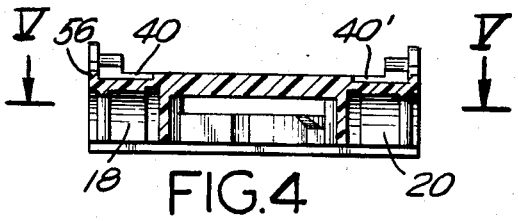
FIG. 4 is a vertical section through the base member illustrated in FIG. 3 taken along the axis of its bearing recesses.
Figure 5:
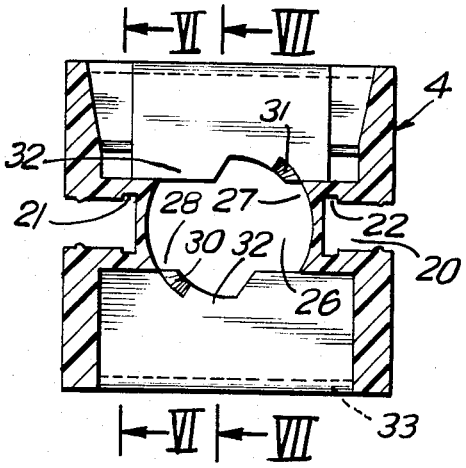
FIG. 5 is a horizontal sectional view taken along the line V—V in FIG. 4.
Figure 8:
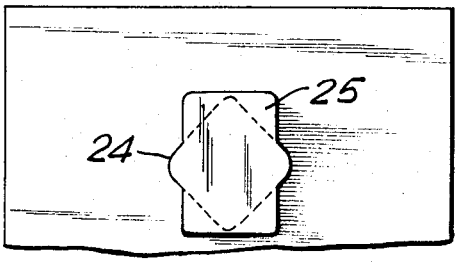
FIG. 8 is a partial top view of a fastening plate.

Particularly in FIG. 1, but also in FIG. 2, the novel design of a ski guard is illustrated, constructed in the form of a tiltable stirrup which could not be produced from spring steel wire with the wire bending techniques known at the present time. The stirrup or swivellable part 2 has an inner side 6 facing the other ski and it serves as a stop member to prevent the crossing of the skis, it extends relatively steeply upwardly, close to the vertical, and, at its upper end, forms an angle close to a right angle with the upper transverse part 8 of the stirrup. At the opposite end of the transverse part 8, it is connected to the outer side 10 of the stirrup forming a rounded connection region and the outer side is arcuately shaped diverging from the inner side 6 in the downward direction from the transverse part 8. At the lower end of each of the inner and outer sides 6, 10 of the stirrup 2, a journal axle 14, 15 is formed extending approximately at right angles to the side to which it is connected. The almost right angular bends formed between the sides 10, 6 and the axle journals 14, 15 provide an almost continuous transition from the stirrup to the narrow lateral side surfaces of the ski. The axle journals 14, 15 are in axial alignment but are spaced apart. The inner adjacent ends of the axle journals 14, 15 each end in a radially outwardly extending annular circumferential collar or flange 16, 17 which serves to secure the axial position of the journals in the base member 4. As can be seen in FIG. 4, support recesses 18, 20 are formed in the underside of the base member and the inner ends of each recess has a circumferential groove 21, 22 for rotatably supporting and axially securing the corresponding collar or flanges 16, 17. For the insertion of the axle journals 14, 15 into the support recesses 18, 20, each recess has a downwardly open, U-shaped configuration which is closed after the base member 4 is attached to a fastening plate 23, note FIG. 8. The fastening plate is intended to be secured by an adhesive to the surface of a ski. The connection between the fastening plate 23 and the base member 4 is effected by a bolt 24 rigidly secured on the fastening plate. The bolt 24 is non-circular in transverse cross section and it is provided with a flat head 25. Bolt 24 engages within a central opening 26, note FIG. 5, in the base member 4. Lateral cutouts 27, 28 in the opening 26 make it possible to guide the head 25 into the opening.

After relative rotation between the fastening plate 23 and its bolt 24 with the base member 4, the underside of the bolt head slides over ramp-like surfaces 30, 31 adjacent to the lateral cutouts 27, 28 passing over an edge 32 of the opening so that the base member is pressed closely against the fastening plate 23. In the end position of the relative rotation between the fastening plate 23 and the base member 4, edges 33 which project downwardly from the base member lock against the boundary edge 34 of the fastening plate 23.

At a distance spaced from the swivel axis of the stirrup 2 as defined by the axle journals 14, 15, perpendicularly to the swivel axis, a holding member 35 is formed integrally with the stirrup at the intersection between the upper transverse part 8 and the arcuate outer side 10. From its point of attachment with the stirrup 2, the holding member is in separate spaced relation to the inside surface of the stirrup 2. The attachment point 36 is located at the inside of the intersection of the transverse part 8 and the outer side 10 of the stirrup 2. While the remainder of the holding member from the attachment point 36 is spaced from the stirrup 2, it follows the inside shape of the stirrup. As shown in FIG. 1, from the attachment point 36, the holding member has a shorter side 42 extending generally parallel with the upper transverse part 8 and at the opposite end of the transverse part 8 from the attachment point 36, the holding member is bent downwardly forming a longer side 43 spaced inwardly from the inner side 6 of the stirrup 2. At its lower end, the holding member 35 has a support member 38 spaced upwardly from the axle journal 15. Accordingly, the angular shape of the holding member 35 has the advantage that its support member 38, at its lower free end, is supported with a bias at a support surface 40 on the base member 4 for rigidly securing the stirrup 2 in the upright working position. In the support member 38, the biasing action acting on the holding member 35 results from a slight deflection of the shorter side 42 at the upper end of the holding member.

On the base member 4, on the opposite side in the axial direction from the support surface 40 there is another support surface 40′ located above the recess 20. With these support surfaces 40, 40′ the stirrup 2 can be held in two positions in the base member 4 spaced apart from one another by 180°. This arrangement has the advantage that the stirrup can be used for the left ski, FIG. 1, as well as for the right ski by merely assembling the base member turned through 180°.

Figure 6:
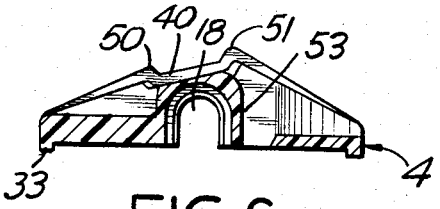
FIG. 6 is a view of the base member taken along the line VI—VI in FIG. 5.
Figure 7:
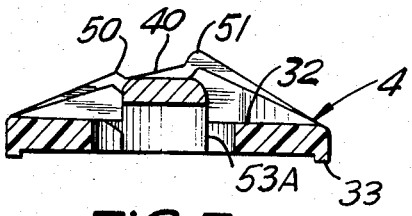
FIG. 7 is a sectional view taken along the line VII—VII in FIG. 5.

As displayed in FIGS. 6 and 7, the surfaces 40, 40′ each has a slight inclination so that the stirrup 2 assumes a corresponding inclination toward the skiing direction of the ski because the support surface 44 on the lower side of the support member 38 of the holding member 35 extends perpendicularly to the longer side 43 of the holding member.

If a force of a specific magnitude acts on the stirrup 2 in the long direction of the ski, then the holding member 35 tilts over a boundary edge 46 or 47 of its support member 38 while overcoming a dead-center position. During this movement, the shorter side 42 of the holding member 35 bends slightly upwardly because the distance between the attachment point 36 of the holding member 35 about which the holding member can deflect is greater with respect to the supporting surfaces of the boundary edges 46 or 47 of the support surface 40 of the base member 4 than with respect to the center of the relatively flat support surface 44 of the support member 38.

To assure that the holding member 35 or its longer side 43 can deflect laterally after tilting over the boundary edge 46 or 47, that is, relative to the stirrup 2 in the long direction of the ski, the support surface 40 is provided in a slight recess in the base member 4 and is limited in the long direction of the ski by two upwardly projecting surfaces 50, 51. In the tilting motion, one side surface 52, 53 of the support member 38 on the holding member 35 is supported at one of the upwardly projecting surfaces 50, 51 so that the boundary edge 46 or 47 on the support member 38 can slide over the surface 40 in the direction toward the opposite upwardly projecting surface 51, 50. The spring tension which results from this elastic deflection tends to swivel the stirrup back into its upright working position.

When the skis are being transported, to hold the stirrups in a position completely swivelled down against the ski surface, a second support surface 53A is provided for this extreme swivel position and it extends approximately at a right angle to the support surface 40. This second support surface 53A provides a surface at which the support surface 44 of the holding member 35 can be held.

Figure 3:
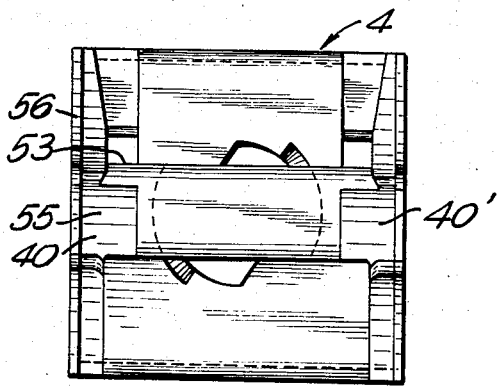
FIG. 3 is a top view of a base member for supporting the parts shown in FIGS. 1 and 2.

As can be seen in FIGS. 3, 6 and 7, the second support surface 53A is offset from the swivel axis of the stirrup 2 so that the support member 38 of the holding member 35 only contacts the second support surface 53A after the manual deflection of the plane of the stirrup away from the stirrup side 6 and subsequent swivelling of the stirrup. During this deflection motion, the support member 38 of the holding member 35 slides due to an inwardly directed extension 55 on the support surface 40. An oppositely directed deflection toward the edge of the base member is prevented by an upwardly extending edge 56.

The width of the support member 38, that is, the distance between its boundary edges 46, 47, note FIG. 2, determines the amount of deflection of the holding member from the plane of the stirrup 2, or the magnitude of the shear-like relative motion between the stirrup inner side 6 and the side 43 of the holding member for a specific angular extent of the swivel motion of the stirrup 2 and, consequently, also determines the spring characteristic of the ski guard based on its dimensions and material characteristics.

During tilting of the stirrup 2, not only is there bending in the holding member 35 but there is also differently directed elastic deformation movement, such as torsion and compression. As mentioned, when the dead-center position is overcome, there is an upward deflection of the holding member away from the swivel axis and in the embodiment shown in FIG. 1 this upward deflection is effected by the shorter side 42 of the holding member.

The following exemplary embodiments show alternative ways of arranging the holding member with adequate elasticity so that it is able to overcome the dead-center position.

Figure 9:
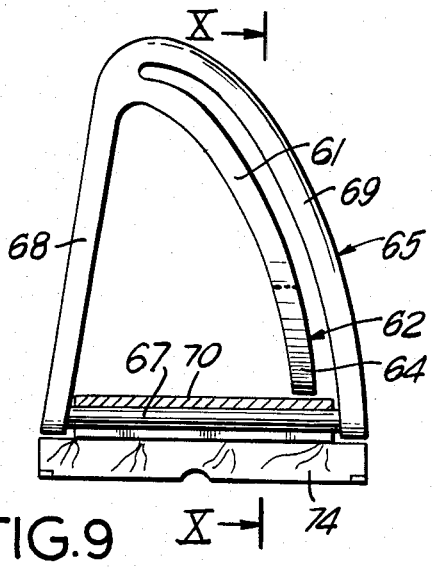
FIG. 9 is a front view, similar to FIG. 1, of another embodiment of a ski guard viewed in the long direction of a right ski with the base member for the ski guard shown in section.
Figure 10:
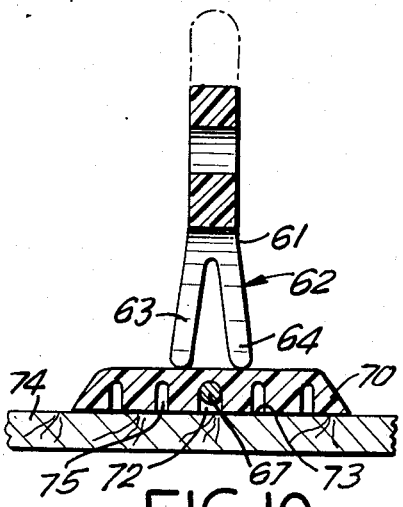
FIG. 10 is a cross-sectional view taken along the line X—X in FIG. 9.

In FIG. 9 a holding member 61 is formed as a part of a stirrup 65 and it has the shape of an arc in the plane of FIG. 9 and can bend in its longitudinal direction when a force occurs. The holding member 61 has its attachment point to the upper end of the side 68 at the intersection of side 68 with side 69. As the holding member 61 curves downwardly it is spaced from and follows the curved configuration of side 69. The lower end part of the holding member 61 forms a support member 62 and it is divided in a fork-like manner into two sides 63, 64, note FIG. 10, which contribute to the bending elasticity in the long direction of the ski when the stirrup 65 is tilted.

As distinguished from the embodiment illustrated in FIGS. 1 to 8, the stirrup 65 has a swivel axle 67 connected to and extending continuously between the lower ends of the sides 68, 69. Base member 70 has a downwardly open recess 72 which is U-shaped in cross-section and is arranged to receive the swivel axle 67. Holding member 61 secures the stirrup 65 in the recess. The base member 70 is attached by an adhesive foil 73 to the surface of the ski 74. The underside of the base member 70 has grooves 75 so that the base member can follow the bending motion of the ski without becoming detached.

Figure 11:
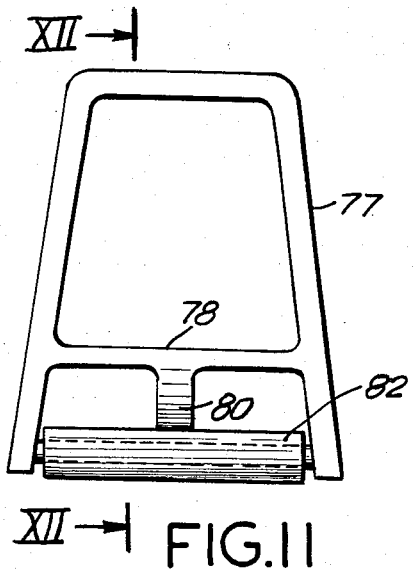
FIG. 11 is a front view of another embodiment of a ski guard incorporating the present invention.
Figure 12:
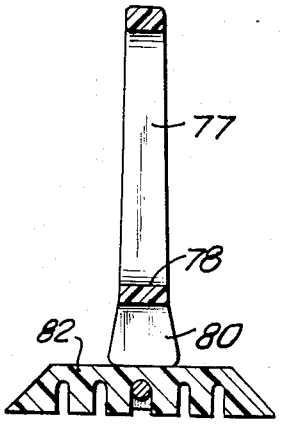
FIG. 12 is a cross-sectional view taken along the line XII—XII in FIG. 11.

In the embodiment depicted in FIGS. 11 and 12, the motion required to overcome the dead-center position is made possible by deflecting a bridge-shaped holding member 78 secured to both sides of the stirrup 77. This holding member 78 is spaced upwardly from and in general parallel relation with the swivel axis of the stirrup. Holding member 78 has a support member 80 projecting downwardly from its lower side spaced approximately equidistantly inwardly from both sides of the stirrup 77. The lower end of the support member contacts the upper surface of the base member 82.

Figure 13:
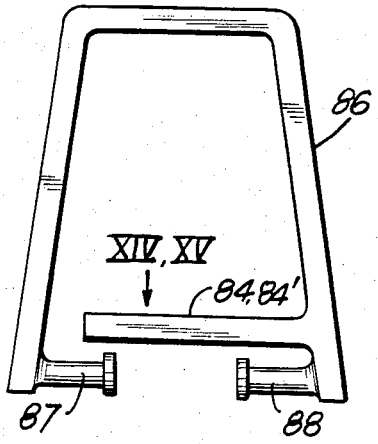
FIG. 13 is a front view of the tiltable part of yet another embodiment of a ski guard incorporating the present invention.

In the embodiment illustrated in FIG. 13, a holding member 84, 84' extends parallel to the swivel axis of the stirrup or to its axle journals 87, 88. The holding member 84, 84' is secured to only one side of the stirrup 86 and its other end is free and is provided with a support member 90, 90' which contacts the upper side of the base member, not shown, in the assembled position. The base member may be similar to that shown in FIGS. 10 or 12.

Figure 14:
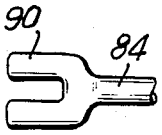
FIGS. 14 and 15 are partial views taken in the direction of arrows XIV, XV in FIGS. 13 and 16 illustrating further embodiments.
Figure 15:
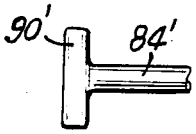
Figure 16:
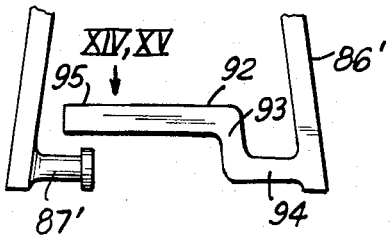
FIG. 16 is a front view of the lower portion of the tiltable part of still another embodiment of a ski guard incorporating the present invention.

In FIG. 16 an embodiment similar to that in FIG. 13 is displayed, however, there is the difference that the holding member has an offset bend 93 between its ends and the offset bend 93 connects it to the journal 94 and not to the side of the stirrup 86'. At its free end spaced from the journal 94, the holding member 92 has a support member 95 constructed in the manner illustrated in FIGS. 14 or 15.

When the stirrup 86 or 86' is tilted about its axis determined by the axle journals 87, 88 or 87', 94, the support member 90, 90' or 95 is supported with one of its outer edges on the upper surface of the base member, not shown, and the holding member 84, 84' or 92 first bends upwardly and then to the side so that it can return the stirrup to the erect position.

While specific embodiments of the invention has been shown and described in detail to illustrate the application of the inventive principles, it will be understood that the invention may be embodied otherwise without departing from such principles.

I claim:

1. A tiltable ski guard comprising a base member arranged to be attached to a ski and a swivel part having at least one bearing axle pivotally mounted in said base member with the bearing axle arranged to extend transversely to the ski, wherein the improvement comprises an elongated holding member attached to said swivel part at least at one location and being separated from and extending along said swivel part over at least a part of the length of said holding member extending from the attachment location, said holding member being pivotally displaceable with said swivel part about the bearing axle thereof and being elastically deformable relative to said swivel part, and said holding member has at least one support surface thereon in contact with said base member and said at least one support surface is positioned on said holding member at a location spaced remotely on said holding member from the attachment location of said holding member to said swivel part where said holding member is separate from said swivel part.

2. A tiltable ski guard, as set forth in claim 1, wherein said holding member at the support surface thereof is bifurcated.

3. A tiltable ski guard, as set forth in claim 1, wherein said support surface of said holding member extends transversely of the length of the holding member.

4. A tiltable ski guard, as set forth in claim 1 or 3, wherein said holding member has a support member forming said support surface, said base member has a surface thereon arranged in surface contact with said support surface on said support member of said holding member.

5. A tiltable ski guard, as set forth in claim 4, wherein said base member has a recess with said surface in contact with said support surface on said holding member located in said recess.

6. A tiltable ski guard, as set forth in claim 1, wherein said swivel part has a pair of opposite sides extending transversely of the bearing axis thereof, said holding member is attached to at least one of said opposite sides at a location spaced tranversely outwardly from the bearing axis, said holding member extends generally parallel to said bearing axis.

7. A tiltable ski guard, as set forth in claim 1, wherein said swivel part is in the shape of a stirrup-shaped member and said stirrup-shaped member and said holding member attached thereto is formed of a springy-elastic plastics material and the cross-sections of said stirrup-shaped member and said holding member are variable.

8. A tiltable ski guard, as set forth in claim 7, wherein said stirrup-shaped member has a pair of opposite sides extending transversely of the bearing axis and one of said sides extends approximately perpendicularly to the bearing axis and the outer surface of said side is arranged to align with the corresponding outer surface of the elongated side of the ski so that said stirrup-shaped member and base member can be joined to the ski without any gap.

9. A tiltable ski guard, as set forth in claim 8, wherein said bearing axle extends between the opposite said sides of said stirrup-shaped member and said bearing axle and said stirrup-shaped member form a closed ring.

10. A tiltable ski guard, as set forth in claim 1, wherein said at least one bearing axle comprises two bearing axles disposed in axial alignment and are spaced apart from one another, a fastening plate arranged to be attached to the ski, said fastening plate having means thereon for engagement within said base member for securing said base member to the ski.

11. A tiltable ski guard, as set forth in claim 10, wherein said means comprises a bolt secured to and extending outwardly from said fastening plate, a flat head formed on said bolt and having a larger transverse section than said bolt, said base member having an opening therein for passage by said head into said opening, and said head being positionable within and rotatable relative to the opening in said base member for securing said base member onto said fastening member.

12. A tiltable ski guard comprising a base member arranged to be attached to a ski and a swivel part having at least one bearing axle pivotally mounted in said base member with the bearing axle arranged to extend transversely to the ski, wherein the improvement comprises an elongated holding member attached to said swivel part at least at one location and being separated from and extending along said swivel part over at least a part of the length of said holding member extending from the attachment location, said holding member being pivotally displaceable with said swivel part about the bearing axle thereof and being elastically deformable relative to said swivel part, and said holding member has at least one support surface thereon in contact with said base member and said at least one support surface is positioned on said holding member at a location spaced remotely on said holding member with the attachment location of said holding member to said swivel part where said holding member is separate from said swivel part, said holding member has a first end and a second end, said first end of said holding member is attached to said swivel part at a position spaced from said base member, said second end of said holding member forms said support surface and is in contacting engagement with the upwardly facing surface of said base member.

13. A tiltable ski guard comprising a base member arranged to be attached to a ski and a swivel part having at least one bearing axle pivotally mounted in said base member with the bearing axle arranged to extend transversely to the ski, wherein the improvement comprises an elongated holding member attached to said swivel part at least at one location and being separated from and extending along said swivel part over at least a part of the length of said holding member extending from the attachment location, said holding member being pivotally displaceable with said swivel part about the bearing axle thereof and being elastically deformable relative to said swivel part, and said holding member has at least one support surface thereon in contact with said base member and said at least one support surface is positioned on said holding member at a location spaced remotely on said holding member from the attachment location of said holding member to said swivel part where said holding member is separate from said swivel part, said holding member has a support member forming said support surface, said base member has a surface thereon arranged in surface contact with said support surface on said support member of said holding member, said base member has a recess, and said surface in contact with said support surface on said holding member located in said recess, said base member has second support surface thereon spaced from and extending transversely of said support surface located in said recess, and said second surface is arranged for supporting said holding member when said swivel part is tilted flat with the ski surface to which said base member is arranged to be attached.

14. A tiltable ski guard, as set forth in claim 13, wherein said holding member is located in a plane including said swivel part and the bearing axle thereof, said holding member is deflectable in said plane in the direction away from said bearing axle and said second support surface on said base member is offset from said swivel axis in the direction extending transversely of said bearing axle so that after said holding member is deflected in the plane of said swivel part and after said swivel part is rotationally deflected against the surface of the ski, said support surface on said holding member can be supported on said second support surface on said base member.

15. A tiltable ski guard, as set forth in claim 14, wherein said swivel part is formed by a stirrup-shaped member comprising a number of angularly disposed interconnected sides, and said holding member extends parallel to and in spaced relationship from at least one said side of said stirrup-shaped member.

16. A tiltable ski guard, as set forth in claim 15, wherein said holding member is attached to said stirrup-shaped member in the plane including the swivel part and the bearing axle, one of said interconnected sides of said swivel part having a first end adjacent said bearing axle and a second end spaced outwardly from said bearing axle, said holding member has an attachment location to said stirrup-shaped member adjacent to the second end of the one of said interconnected sides and said holding member having a first part extending parallel to said stirrup-shaped member from the attachment location and then is bent angularly and extends in parallel relation with another side of said stirrup-shaped member toward said base member.

17. A tiltable ski guard comprising a base member arranged to be attached to a ski and a swivel part having at least one bearing axle pivotally mounted in said base member with the bearing axle arranged to extend transversely to the ski, wherein the improvement comprises an elongated holding member attached to said swivel part at least at one location and being separated from and extending along said swivel part over at least a part of the length of said holding member extending from attachment location, said holding member being pivotally displaceable with said swivel part about the bearing axle thereof and being elastically deformable relative to said swivel part, and said holding member has at least one support surface thereon in contact with said base member and said at least one support surface is positioned on said holding member at a location spaced remotely on said holding member from the attachment location of said holding member to said swivel part wherein said holding member is separate from said swivel part, said swivel part is a stirrup-shaped member, said stirrup-shaped member having at least two sides extending transversely outwardly from the bearing axis of said bearing axle, said holding member attached to said stirrup-shaped member at a location spaced remotely outwardly from the bearing axis and said holding member extending from the attachment location toward the swivel axis in spaced generally parallel relation with a part of said stirrup-shaped member and the opposite end of said holding member from said attachment location being spaced from the bearing axis, said stirrup-shaped member including a pair of said bearing axles disposed in axial alignment and spaced axially from one another.

18. Tiltable ski guard comprising a base member arranged to be attached to a ski and a swivel part having at least one bearing axle pivotally mounted in said base member with the bearing axle arranged to extend transversely to the ski, wherein the improvement comprises an elongated holding member attached to said swivel part at least at one location and being separated from and extending along said swivel part over at least a part of the length of said holding member extending from the attachment location, said holding member being pivotally displaceable with said swivel part about the bearing axle thereof and being elastically deformable relative to said swivel part, and said holding member has at least one support surface thereon in contact with said base member and said at least one support surface is positioned on said holding member at a location spaced remotely on said holding member from the attachment location of said holding member to said swivel part where said holding member is separate from said swivel part, said swivel part is a stirrup-shaped member, said stirrup-shaped member having at least two sides extending transversely outwardly from the bearing axis of said bearing axle, said holding member secured to said stirrup-shaped member at a location spaced remotely outwardly from the swivel axis and said holding member extending from the point of attachment toward the swivel axis in spaced generally parallel relation with a part of said stirrup-shaped member and the opposite end of said holding member from said location being spaced from the bearing axis, said stirrup-shaped member including one said bearing axle extending across said stirrup-shaped member and secured to the opposite sides thereof.

19. A tiltable ski guard comprising a base member arranged to be attached to a ski and a swivel part having at least one bearing axle pivotally mounted in said base member with the bearing axle arranged to extend transversely to the ski, wherein the improvement comprises an elongated holding member attached to said swivel part at least in one location and being separated from and extending along said swivel part over at least a part of the length of the holding member extending from the attachment location, said holding member being pivotally displaceable with said swivel part about the bearing axle thereof and being elastically deformable relative to said swivel part, said holding member has at least one support surface thereon in contact with said base member and said at least one support surface is positioned on said holding member at a location spaced remotely on said holding member from the attachment location of said holding member to said swivel part where said holding member is separate from said swivel part, said holding member at the support surface thereof is bifurcated, said base member has a surface arranged in surface contact with the bifurcated support surface on said holding member, said holding member is located in a plane including said swivel part and the bearing axle thereof, said holding member is deflectable in said plane in the direction away from said bearing axle, said swivel part is formed by a stirrup-shaped member comprising a plurality of angularly disposed interconnected sides, said holding member extends parallel to and in spaced relation from at least one said side of said stirrup-shaped member, and said holding member and said side of said stirrup-shaped member along which said holding member extends are arc-shaped with the arc-shaped holding member extending between the attachment location to said stirrup-shaped member and said base member.

* * * * *